US005578431A

United States Patent [19]

Fyson

[11] Patent Number: 5,578,431

[45] Date of Patent: Nov. 26, 1996

[54] METHOD OF PROCESSING PHOTOGRAPHIC SILVER HALIDE MATERIALS WITHOUT REPLENISHMENT

[75] Inventor: John R. Fyson, Hackney, United Kingdom

[73] Assignee: Eastman Kodak Company, Rochester, N.Y.

[21] Appl. No.: 436,511

[22] Filed: May 8, 1995

[30] Foreign Application Priority Data

Jul. 30, 1994 [GB] United Kingdom ..... 9415429

[51] Int. Cl.[6] ..... G03C 5/29; G03D 3/04; G03D 3/00

[52] U.S. Cl. ..... 430/401; 430/398; 430/399; 430/400; 430/30; 396/568; 396/577; 396/626; 396/633

[58] Field of Search ..... 354/410, 299, 354/328, 329, 330; 430/398, 403, 30, 399, 400, 401, 494

[56] References Cited

U.S. PATENT DOCUMENTS 4,577,948 3/1986 Lawson et al. ..... 354/299

4,994,837 2/1991 Samuels et al. ..... 354/299

FOREIGN PATENT DOCUMENTS

93/11463 6/1993 WIPO .

OTHER PUBLICATIONS

James, T. H., "The Theory of the Photographic Process", 4th ed. pp. 426–428, New York, 1977.

Keller, Karlheinz, "Science and Technology of Photography", pp. 129–130, Weinheim, 1993.

*Primary Examiner*—Mark F. Huff

*Attorney, Agent, or Firm*—J. Lanny Tucker

[57] ABSTRACT

A method of processing an imagewise exposed photographic silver halide color material in a machine containing a number of processing tanks or processing tanks which are supplied from a non-replenished source, the method comprising increasing the temperature of at least one of the tanks automatically by a predetermined amount related to the area of photographic material already processed and optionally, the time of treatment in said at least one processing tank is increased by a predetermined factor related to the area of photographic material already processed and the volume of the non-replenished processing solution.

8 Claims, 9 Drawing Sheets

METHOD OF PROCESSING PHOTOGRAPHIC SILVER HALIDE MATERIALS WITHOUT REPLENISHMENT

FIELD OF THE INVENTION

The invention relates to a method of processing a photographic silver halide material that enables non-replenished processing baths to provide images of non-varying quality.

BACKGROUND OF THE INVENTION

In the field of photographic processing it is well known to replenish processing solutions to compensate for loss of developer components by consumption by the process and aerial oxidation. Such a replenishment system requires replenisher pump(s), pipework and control means, all of which adds to the cost of the machine.

Some processing machines can be supplied by premixed solutions that are usually run until they produce unacceptable results and are not replenished hence avoiding the replenishment system described above.

The problem experienced with such machines is that the quality of the images produced will deteriorate with continued use of the same solution. This means that the processing solutions must be discarded at a comparatively early stage if unvarying high quality processing is desired.

SUMMARY OF THE INVENTION

According to the present invention there is provided a method of processing an imagewise exposed photographic silver halide color material in a machine containing a number of processing tanks or processing tanks which are supplied from a non-replenished source, the method comprising increasing the temperature of at least one of the tanks automatically by a predetermined amount related to the area of photographic material already processed and optionally, the time of treatment in said at least one processing tank is increased by a predetermined factor related to the area of photographic material already processed and the volume of the non-replenished processing solution.

The materials processed employing the present method have substantially unvarying sensitometric quality over a longer time period than when the temperature of the processing tank remains constant.

BRIEF DESCRIPTION OF THE DRAWINGS

In the accompanying drawings FIG. 1 is a schematic diagram of processing apparatus that may be used while

DETAILED DESCRIPTION OF THE INVENTION

The present method applies to a wide variety of processing situations. For example, this would include both color and black-and-white materials.

The present invention is particularly applicable to processing machines that accept a replaceable solution supply unit in which there are separate compartments holding the various solutions needed. Preferably one or more of the processing solutions are circulated between the supply unit and the processing tank continuously or intermittently.

In one embodiment of the present invention the processing machine is controlled by a microprocessor that receives data from the processing machine as to the area of photographic material processed. In response to this data the temperature and, optionally the time of treatment, of at least the developer solution is increased by a predetermined factor.

In order to find out what the predetermined amount should be, measurements are taken during a processing run of photographic material exposed to a color step wedge that has been processed at different temperatures. The speed of each image can then be determined in the usual way. This will then give an indication of the way in which the temperature and optionally the time of treatment should be increased to compensate for apparent loss of speed and/or contrast due to solution deterioration.

Typically the increase in temperature per print will be in an amount of 0.05° to 0.25° C., preferably 0.075° to 0.2° C. per A4-sized print in 500 ml color developer.

Alternatively the temperature is increased by an amount of 0.01° to 0.10° C. per A4-sized print in 500 ml color developer and the treatment time is increased by a factor in the range 1.0016 to 1.016 per A4-sized print in 500 ml color developer.

Preferably the temperature is increased by an amount of 0.03° to 0.05° C. per A4-sized print in 500 ml color developer and the treatment time is increased by a factor in the range 1.005 to 1.012 seconds per A4-sized print in 500 ml color developer.

It is, of course, the developer solution that is particularly critical in most processes but it is not the only solution to which the present method can be applied. For example the bleach, fix or bleach-fix solutions can be treated similarly.

Figure 1:
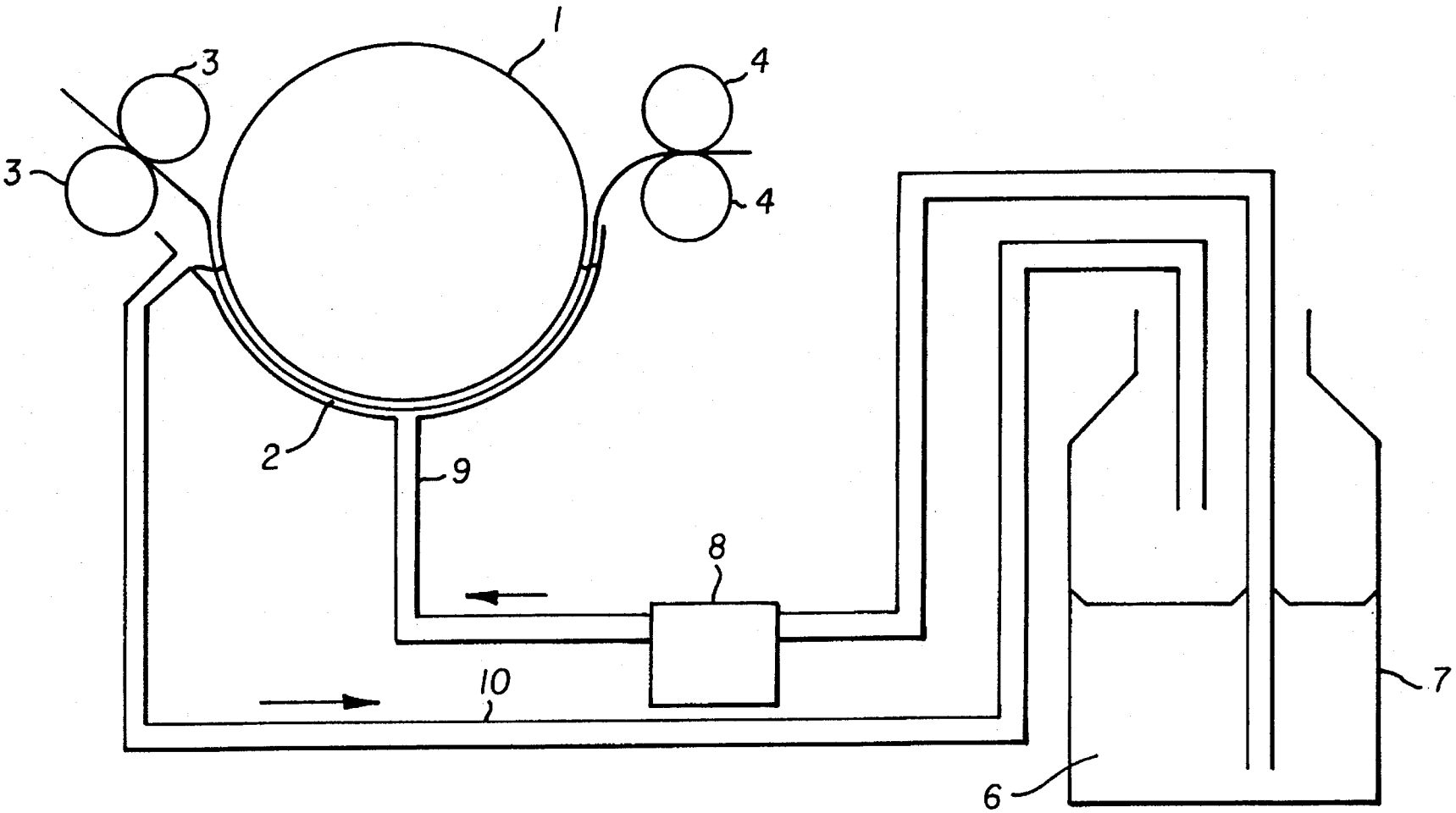

In FIG. 1 of the accompanying drawings the processing machine comprises a rapidly rotating processor drum (1) which rotates in a tank of small volume (2) having input transport rollers (3) and output transport rollers (4) through which the sheet of photographic material is driven. The processing machine will also comprise other processing tanks (not shown) as is well understood. The processing solution (6) for tank (2) is held in reservoir (7) and is circulated by pump (8) through pipes (9) and (10).

A preferred type of photographic material to be processed by the present method is negative color materials. A particular application of this technology is in the processing of silver chloride color paper, for example paper comprising at least 85 mole percent silver chloride.

Typically the photographic elements can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in this invention, reference will be made to Research Disclosure, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido) ethyl)aniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Photographic processing methods are described in Section XIX of Research Disclosure.

The following Examples are included for a better understanding of the invention.

EXAMPLE 1

All processing was carried out in a processing machine in which the photographic material experiences high agitation by contacting a rotating drum, similar to one made of several units described in PCT publication No. WO 93/11463.

Processing solutions were pumped continuously through the processor tanks by a peristaltic pump pumping 25 mls/min. One tank's recirculation system is shown in FIG. 1.

KODAK™ 'Supra' color paper, surface F, sheets of size A4 were used for testing the sensitometry every ten or so processed sheets. This was exposed to a neutral 0.15 log exposure wedge. The process was seasoned by processing a fully exposed A4 sheet of the same paper followed by three unexposed sheets, then another fully exposed sheet followed by three unexposed ones and so on. This approximated 25% maximum exposure that is considered to be about equivalent to average printed density of normal prints. The wedge exposed strips were counted as unexposed strips.

The process sequence was:

| Process | Time (seconds) | Temp. | Total tank + circulation volume |
|---|---|---|---|
| Develop | 30 | 40° C. | 500 mls |
| Bleach-fix | 30 | 22° C. | 500 mls |
| Stabilize | 15 | 22° C. | 500 mls |
| Stabilize | 15 | 22° C. | 500 mls |
| Stabilize | 15 | 22° C. | 500 mls |

The experiment was repeated increasing the developer temperature by an amount of 0.15° C. for every print processed.

The starting developer was one with the following formula (this is similar to RA4 replenisher):

| | |
|---|---|
| Triethanolamine | 11.0 ml |
| Diethylhydroxylamine | 6.0 ml |
| CD3* | 7.3 g |
| PHORWITE ™ REU | 3.0 g |
| Disodium EDTA | 3.0 g |
| Catechol disulphonic acid | 3.0 g |
| Potassium chloride | 0.0 g |
| Potassium carbonate | 25.0 g |
| Water to | 1 liter |
| pH adjusted to 10.4 | |

*CD3 is 4-N-ethyl-N-(β-methanesulphonamidoethyl)-o-toluidine sesquisulphate.

The starting formula of the bleach-fix was as follows (this is similar to RA4 bleach-fix NR):

| | |
|---|---|
| 1.56M Ammonium iron(III) EDTA | 275 ml |
| Ammonium thiosulphate | 225 g |
| Sodium sulphite | 42 g |
| Water to | 1 liter |
| pH adjusted to 5.5 | |

The three wash tanks in the processor were filled with fresh RA4 stabilizer.

Figure 2:
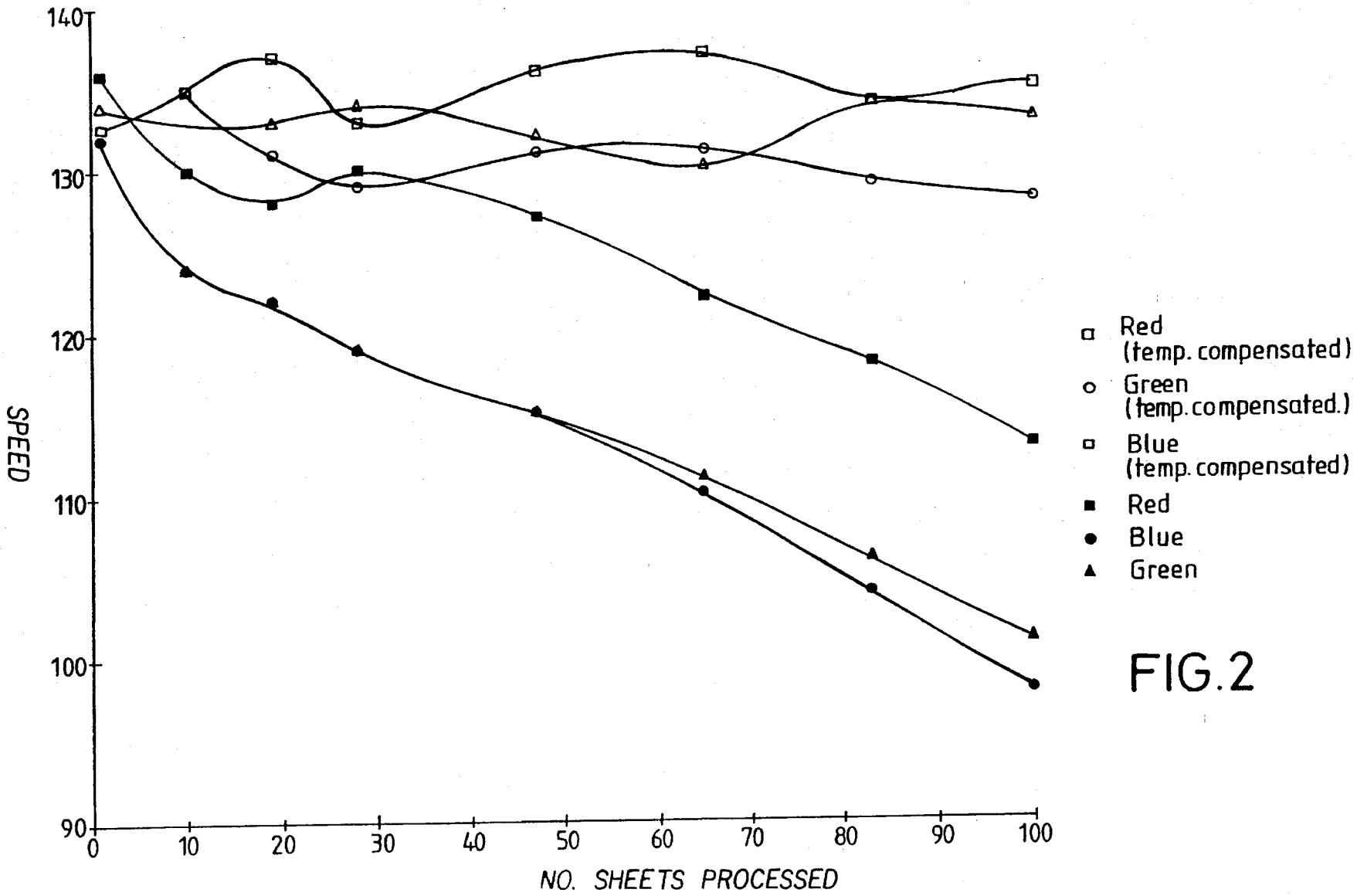
FIGS. 2–5 represent the results of the Examples.
Figure 3:
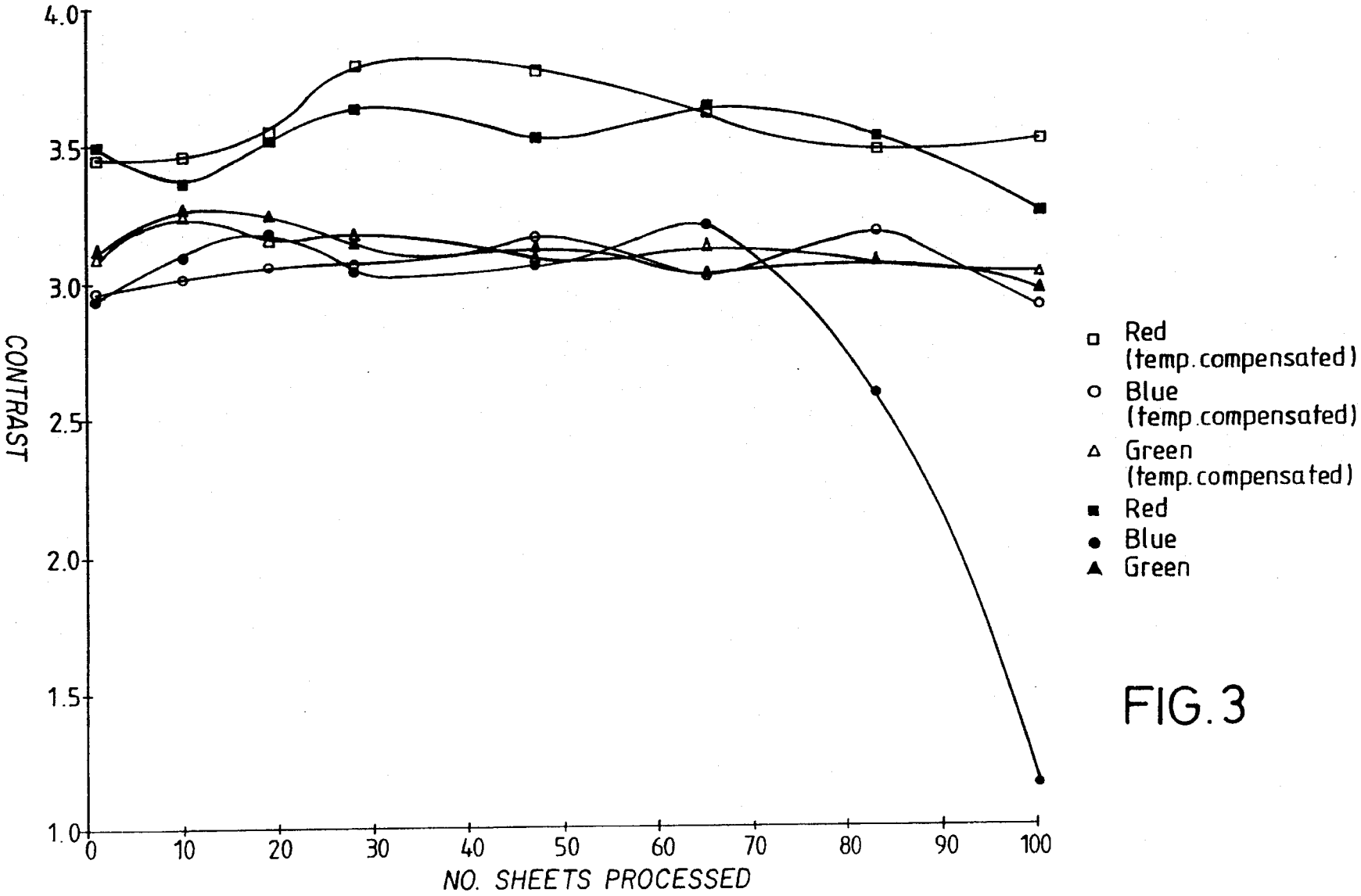

After the equivalent of 100 sheets of paper had been processed along with the exposed wedges, the contrasts of the exposed wedges for each color unit were determined. FIGS. 2 and 3 show the change in speed and contrast respectively of the paper with seasoning for a process without and with increasing developer temperature. The process with the increasing temperature shows little change in contrast whereas the process at constant temperature shows a considerable change (downwards).

EXAMPLE 2A

The procedure of Example 1was repeated, increasing the developer temperature by an amount of 0.05° C. and the time by a factor of 1.024 for every print processed.

EXAMPLE 2B

Figure 4A:
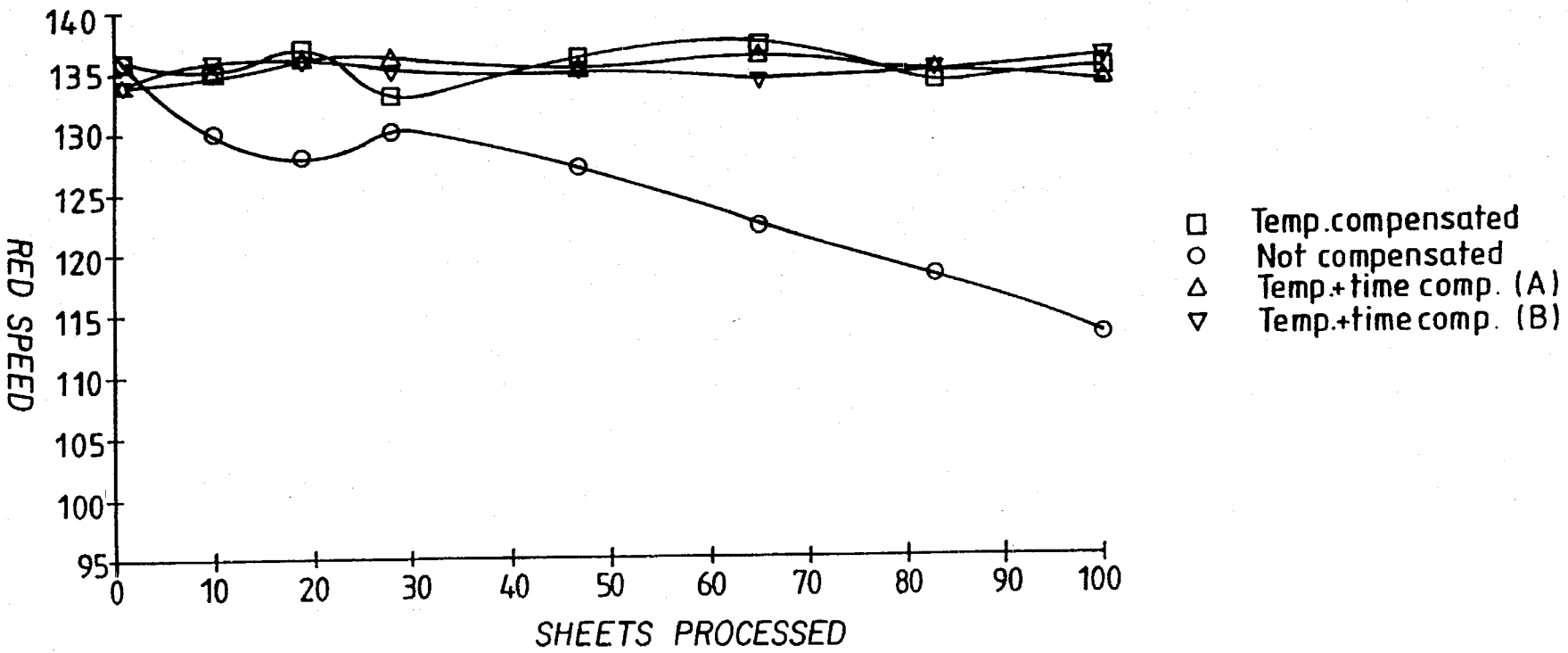
Figure 4B:
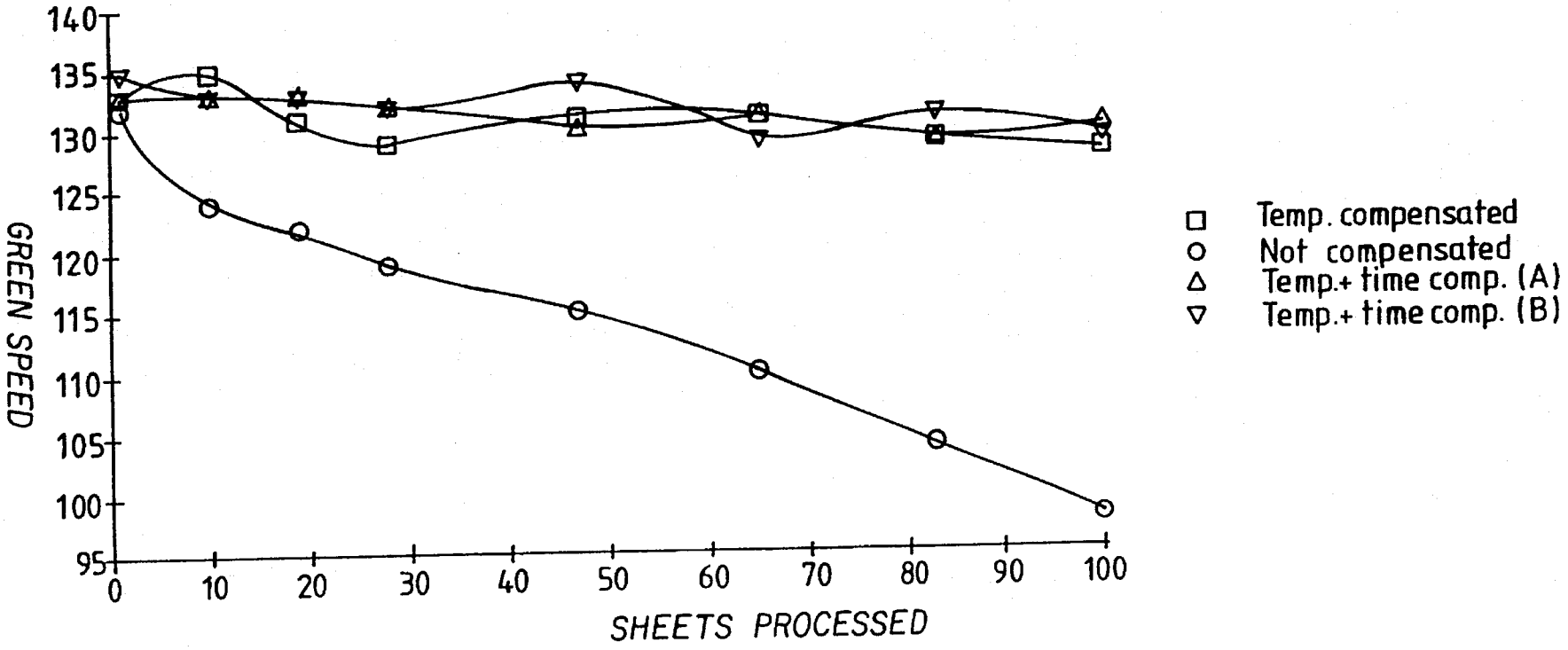
Figure 4C:
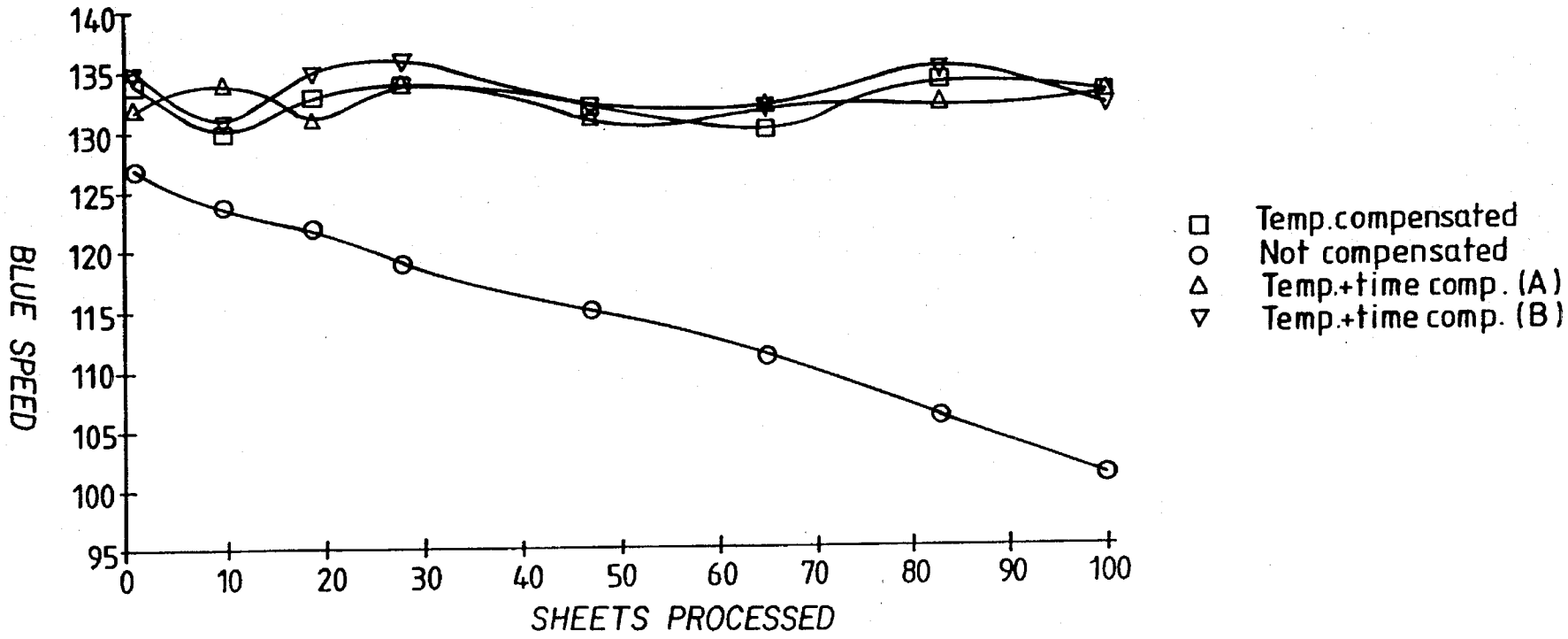
Figure 5A:
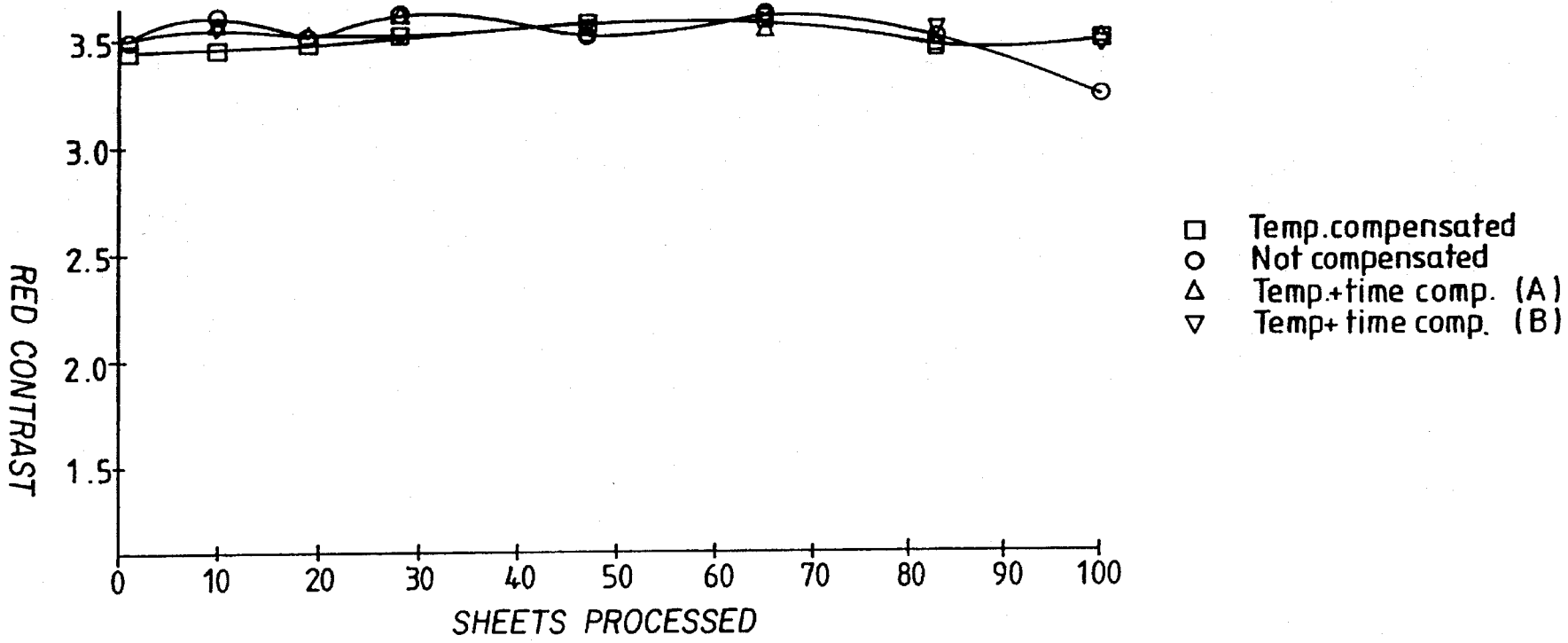
Figure 5B:
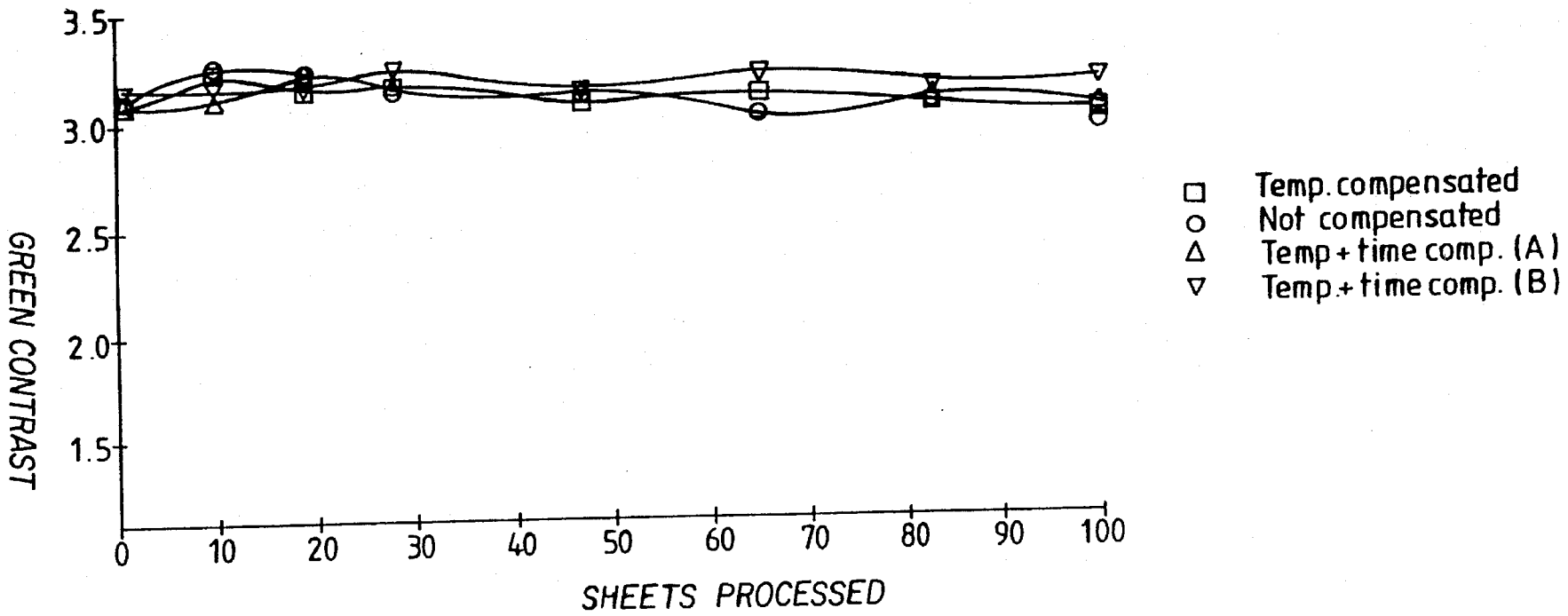
Figure 5C:
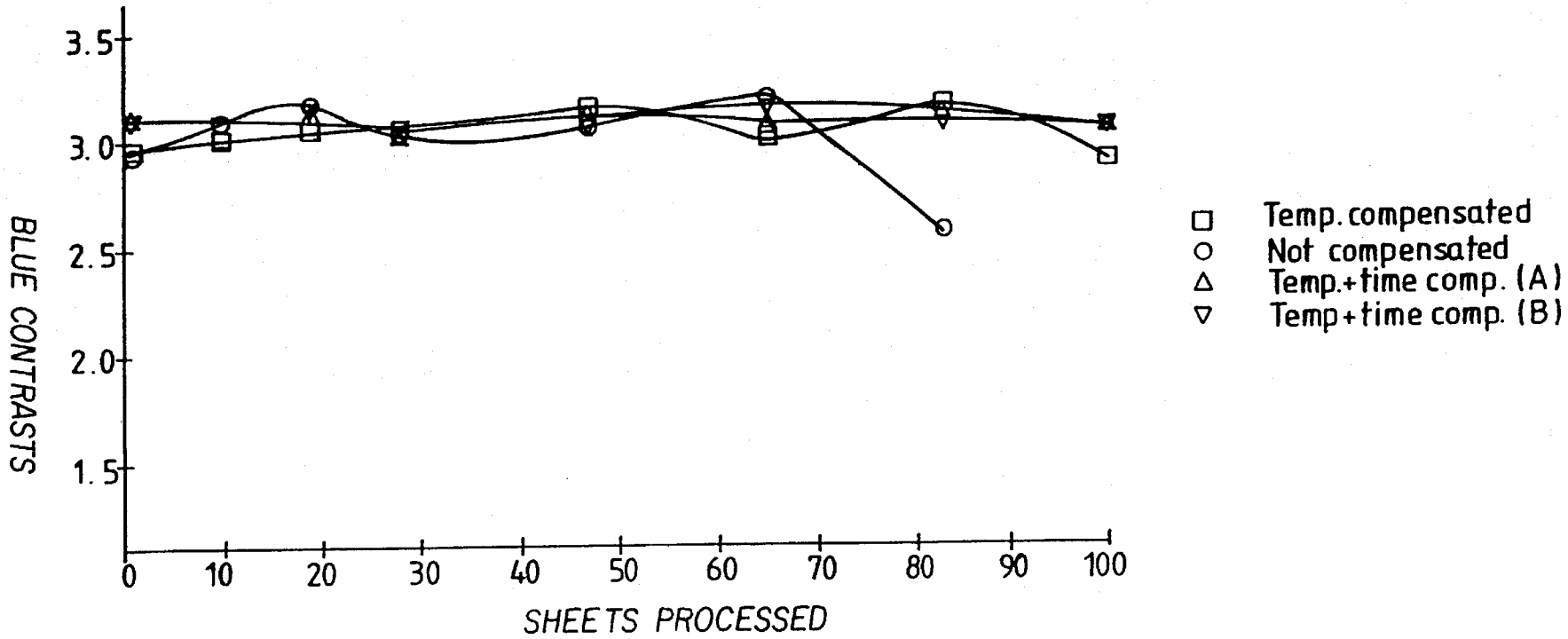

The procedure of Example 1 was repeated, increasing the developer temperature by an amount of 0.1° C. and the time by a factor of 1.012 for every print processed. The results are shown in FIGS. 4 & 5 that are respectively plots for speed change and contrast change for no change (control) and for the conditions described in Examples 1 and 2(A & B).

The change in temperature only shows little change in contrast but the speed decreases. Increasing both time and temperature maintains sensitometry without excessive time or temperature. The high temperature needed to maintain the process without a process time change caused considerable evaporation (120 ml/hr) at 55° C. whereas the loss at 45° C. was only 53 ml/hr.

The invention has been described in detail with particular reference to preferred embodiments thereof, but it will be understood that variations and modifications can be effected within the spirit and scope of the invention.

I claim:

1. A method of processing an imagewise exposed photographic silver halide material having a silver halide emulsion comprising at least 85 mol % silver chloride, in a machine containing a number of either non-replenished processing tanks or processing tanks which are supplied from a non-replenished source, the method comprising contacting said silver halide material with a processing solution in each processing tank, and increasing the temperature of at least one of the processing tanks automatically by an amount directly related to the area of photographic material already processed, and optionally, increasing the time of treatment in said at least one processing tank by a factor directly related to the area of photographic material already processed and the volume of the processing solution in said at least one processing tank, said processing solution being contained in a replaceable solution supply unit comprising separate holder compartments for each processing solution, and wherein one or more of said processing solutions are circulated between said solution supply unit and said at least one processing tank continuously or intermittently.

2. The method of claim 1 in which said at least one processing tank contains a color developer bath.

3. The method of claim 2 in which the temperature is increased by an amount of from 0.01° to 0.10° C. per A4-sized sheet processed and the treatment time in the color developer is increased by a factor in the range of from 1.0016 to 1.016 per A4-sized print processed in 500 ml developer.

4. The method of claim 2 in which the temperature of the color developer bath is increased by an amount of from 0.05° to 0.03° C. and the treatment time is increased by a factor in the range of from 1.005 to 1.012 per A4-sized print processed in 500 ml developer.

5. The method of claim 1 in which the temperature is increased by an amount of 0.05° to 0.25° C. per A4-sized sheet processed in 500 ml of processing solution.

6. The method of claim 1 in which the temperature is increased by an amount of from 0.075° to 0.20°C. per A4-sized sheet processed in 500 ml of processing solution.

7. The method of claim 1 in which the photographic material is a black-and-white material.

8. The method of claim 1 in which the photographic material is a negative color paper.

* * * * *